US005715642A

United States Patent [19]

Buers

[11] Patent Number: 5,715,642

[45] Date of Patent: Feb. 10, 1998

[54] STEEL-FRAME SYSTEM AND MEMBER

[75] Inventor: George P. Buers, Garden Grove, Calif.

[73] Assignee: Steel Framing Supply, Placentia, Calif.

[21] Appl. No.: 515,684

[22] Filed: Aug. 16, 1995

[51] Int. Cl.[6] ..... F04C 3/02

[52] U.S. Cl. ..... 52/633; 52/771; 52/656.1; 52/90; 403/171

[58] Field of Search ..... 52/720.2, 648.1, 52/656.1, 633, 634; 403/27, 3, 171; 446/146, 479, 113

[56] References Cited

U.S. PATENT DOCUMENTS

| | | | |
|---|---|---|---|
| 2,632,533 | 3/1953 | MacKenzie | 52/633 |
| 2,733,786 | 2/1956 | Drake . | |
| 2,746,780 | 5/1956 | Comino . | |
| 2,990,920 | 7/1961 | Hoffman, Jr. . | |
| 3,019,866 | 2/1962 | Grabowski . | |
| 3,043,409 | 7/1962 | Kremer et al. . | |
| 3,077,960 | 2/1963 | Lang . | |
| 3,127,961 | 4/1964 | Frazier . | |
| 3,423,898 | 1/1969 | Tracy et al. . | |
| 4,551,957 | 11/1985 | Madray . | |
| 4,688,358 | 8/1987 | Madray | 52/655.1 X |
| 4,697,393 | 10/1987 | Madray | 52/721 X |

FOREIGN PATENT DOCUMENTS

| | | | |
|---|---|---|---|
| 0204748 | 1/1959 | Austria | 52/633 |
| 0614815 | 2/1961 | Canada . | |
| 1165739 | 10/1958 | France . | |
| 1319772 | 1/1963 | France . | |
| 2222504 | 10/1974 | France | 52/633 |
| 0008656 | 12/1953 | Germany . | |
| 0584676 | 11/1958 | Italy | 52/633 |
| 0313951 | 6/1956 | Switzerland . | |
| 0849920 | 9/1960 | United Kingdom . | |
| 0934144 | 8/1963 | United Kingdom | 52/633 |

OTHER PUBLICATIONS

Schwolsky, "Steel Crazy After All These Years", *Builder*, Dec. 1994, pp. 122, and 124–129.

*Primary Examiner*—Wynn E. Wood
*Assistant Examiner*—Winnie Yip
*Attorney, Agent, or Firm*—Knobbe, Martens, Olson & Bear

[57] ABSTRACT

An innovative steel-framing system and method of construction utilizing structural beams having preformed rotating hole patterns therein. The structural beams can be coupled together at various angles by virtue of the rotating hole pattern. The entire framing system is constructed using the same gauge of steel-framing members and without unique connectors. Furthermore, the preformed holes in the structural members allows the use of standard sharp-pointed screws, rather than self-tapping screws which are more time-consuming and costly. The structural members are formed as C-channels and may be coupled together to form stronger members. In this manner, a relatively small inventory of steel members is used, greatly reducing mistakes in the framing process.

20 Claims, 13 Drawing Sheets

STEEL-FRAME SYSTEM AND MEMBER

FIELD OF THE INVENTION

This invention relates to an innovation steel-frame system particularly adapted for residential structures and, in particular, to an innovative structural member therefor.

BACKGROUND OF THE INVENTION

The prior art is replete with examples of prior structural systems comprising steel structural members, having a wide variety of hole patterns therein, adapted to be connected to one another by nuts and bolts. Such systems are rarely, if ever used in connection with steel framing due to the amount of time required to erect these structures. For example, Canadian Patent No. 614815 discloses means for connecting structural units having a plurality of holes therein. As seen in the prior art illustration of FIG. 1, four elements 20*a–d* are shown attached at varying angles to a single horizontal element 22. All of the elements have at least three bolts extending through aligned holes therein. The specific arrangement of bolt holes in the elements allows for the varied angle of connection. Unfortunately, the use of bolts to connect structural members together in steel framing systems is impractical, as the bolts are relatively expensive and require a considerable amount of time per connection. Thus, such systems typically gained acceptance, if at all, in erecting customized shelving and other similar applications.

Currently, residential steel framing is typically performed utilizing light-gauge galvanized steel cold formed into C-shaped components. The C-shaped components are available in a wide range of sizes and thicknesses. The thicknesses used for residential construction range from 12- to 25-gauge. Typically, thicker gauge metal is used for load-bearing joists, studs, headers, and roof framing, and thinner gauge metal for nonload-bearing studs (often called drywall studs). To identify the size, gauge, and length of a piece, manufacturers stamp or label the steel. Some pieces are even color coded according to gauge (i.e., spray painted various colors on one end, indicating the gauge).

The anatomy of a steel-framed house is basically the same as those built with wood. Steel framing picks up the loads and transfers and distributes them just like wood framing. Joists, beams, studs, headers, trimmers, and cripples are used as in wood framing. The sequence of construction is likewise similar to the method of constructing wood-framed houses.

The large number of varying thicknesses and sizes of steel-framing members currently used is illustrated in the floor construction shown in FIG. 2. The ends of horizontal C-shaped joists 24 fit into track material 26 extending horizontally along the foundation 28. The track material 26 is fastened securely to the foundation 28 through the use of a plurality of angled clips 30 and bolts 32 cast into the foundation. The C-shaped joists 24 fasten to the track material 26 by driving screws (not shown) vertically downward through the flanges of the track material and C-shaped joists and installing a screwed clip that attaches the joist web to the track. Web stiffeners 34 consisting of vertical pieces of stud material screwed to the track 26 and to the web 36 at the ends of the joists 24 to reinforce the construction. After a plywood subfloor 38 is attached over the C-shaped joists 24, an inverted track 40 is mounted along an outer wall 42. The inverted track receives the bottom ends of C-shaped wall studs 44. The wall studs 44 must be aligned over the load-bearing floor joists 24 at regular intervals (typically 16 or 24 inches). These studs 44 attach to the track 40 utilizing screws through the track flanges. Typically, the tracks 26, 40 are light-gauge steel, while the load-bearing joists 24 and wall studs 44 are a heavier gauge. Roof trusses may be fabricated on site from C-shaped metal elements, but particular attention must be paid to the connections to the wall studs. Typically, gussets and hurricane clips are used to reinforce the connection between the wall studs and roofs.

The various structural elements are typically secured to one another by means of Tek screws. This, however, has numerous disadvantages. For example, the Tek screws required to cut through the steel are relatively expensive. Further, even with the use of Tek screws, drilling through the structural members with Tek screws is a relatively slow and difficult process. Finally, the structural members must be clamped together before attachment to prevent the creation of burrs between the structural elements which would otherwise significantly weaken the strength of the connection by reducing the contact area between the members. As will be appreciated, the need to clamp each screw connection greatly increases the time of construction, pushing up labor costs.

The wide variety of gauges and types of structural elements used in erecting a steel-frame structure also creates an inventory control headache for the builder. Even when the correct amounts of the proper shaped members and gauges are purchased, it is common for errors to occur in the field and, specifically, for the wrong gauge material to be cut and even erected. If the components are disassembled, there is added cost from the disassembly time. If the material is not disassembled, there is the potential of liability due to the structure not satisfying the building requirements as to strength. These problems create added labor and material costs.

Due to these added labor and material costs, steel framing has failed to gain widespread acceptance for residential framing. This is undesirable, as steel framing offers increased strength and fire resistance over other materials, such as wood, which is particularly desirable in dry climates in high earthquake risk areas, such as Southern California.

One effort to solve this problem is disclosed in U.S. Pat. No. 4,551,957 to Madray. In this patent an effort is made to standardize the number of structural members utilized by providing a variety of connectors to secure the structural members to one another. Madray, however, utilizes multiple gauge connectors to secure the structural members together. In addition, both the structural members and the connectors are prepunched to permit the connectors to be secured to the structural members more quickly and easily. FIG. 3 illustrates a structural beam 48 of Madray having a plurality of hole patterns 50 along its length at 6 inch intervals. The 6 inch hole pattern spacing does not accomodate traditional 16 inch on-center framing. The series of hole patterns accommodates the connectors mentioned above having similar hole patterns. Disadvantageously, a plurality of connectors are required to connect two beams at different angles. That is, different connectors are used for forming roof connections for 4/12, 6/12, 9/12 and 12/12 rise over run slopes. These connectors are easily mistaken.

Unfortunately, this system also has a number of drawbacks. Specifically, the use of connectors results in a reduced strength of the member. Likewise, the use of the connectors also can create its own inventory control problems.

Accordingly, there is needed an improved steel-framing system which will permit the reduction in the number of component parts and installation costs, as well as providing for both high strength and versatility.

SUMMARY OF THE INVENTION

There is provided an innovative structural member specifically adapted for use in an innovative steel-framing system. The versatility of the structural member eliminates the need for multiple gauges and connectors. Furthermore, as the structure is provided with a prepunched pattern of holes, the structural members can be assembled quickly, with standard sharp-point screws without the need to preclamp the structural members together.

In accordance with the present invention, a structural beam for framing is provided, comprising a planar rectangular web having first and second flanges integrally attached thereto and extending perpendicularly from two lateral side edges. The web defines a longitudinal axis extending between a first end and a second end. The first and second flanges also extend substantially between the first and second ends of the web. A first lip integrally formed with the first flange extends inwardly parallel to the web towards a second lip integrally formed with the second flange and also extending parallel to the web. The structural beam thus comprises a C-shaped channel member. The web further defines an inner planar surface within the C-shaped channel member and an outer planar surface. Furthermore, a plurality of identical hole patterns are defined in the web.

Each of the identical hole patterns comprises a conduit aperture located along the longitudinal axis of the web, a first center hole also located along the web longitudinal axis, and a plurality of outer holes positioned in a first circular arrangement about the first center hole. The hole pattern also includes a second center hole located along the longitudinal axis of the web and a second plurality of holes positioned in a second circular arrangement therearound. Each of the center and outer holes is sized and shaped to receive a screw. In a preferred embodiment, the first circular arrangement of outer holes overlaps the second circular arrangement of outer holes.

Each of the conduit apertures is spaced along the rectangular web so that the first and second center holes of each identical hole pattern is positioned between two spaced conduit apertures. In a preferred embodiment, the first and second center holes are located closer to a center position between two conduit apertures along the longitudinal axis of the web than any other hole. Preferably, only five holes in each of the plurality of hole patterns, including the conduit aperture, are aligned with the longitudinal axis. In one aspect of the present invention, the first and second plurality of outer holes each includes four groupings of holes, a first and third grouping of holes axisymmetrically disposed about the respective center hole, and a second and fourth grouping of holes axisymmetrically disposed about the center hole. Preferably, each of the groupings has at least three holes. Furthermore, the first circular arrangement includes a first pair of holes perpendicular to the longitudinal axis so that a line connecting these holes intersects the first center hole. Likewise, the second circular arrangement includes a second pair of holes perpendicular to the longitudinal axis so that a line connecting these holes intersects the second center hole. The structural beam also preferably includes a third pair of holes perpendicular to the longitudinal axis so that a line connecting the third pair of holes intersects the axis of the conduit aperture.

In accordance with another aspect of the present invention, a structural framing unit comprising a first structural beam and a second structural beam is provided. Each of the first and second structural beams includes a rectangular web having inner and outer planar surfaces, a first end, a second end, a first side, and a second side. The web defines a longitudinal axis extending between its ends and a plurality of identical hole patterns. Each of the hole patterns includes a conduit aperture and a first center hole along the longitudinal axis of the web. A first plurality of outer holes is provided in a first arrangement about the first center hole. Each of the outer holes is sized and shaped to receive a screw. The outer holes include four groupings around the center hole. The first grouping of holes is axisymmetrically opposed to a third grouping of holes, and a second grouping of holes is axisymmetrically opposed to a fourth grouping of holes. The structural beam further includes first and second flanges integrally formed with and extending perpendicularly from the rectangular web. To form the structural framing unit, a first screw extends through one of the center holes of the first beam and one of the center holes of the second beam to secure the outer planar surfaces in juxtaposition, whereby the beams are rotatable about the screw to at least four discrete angles. Preferably, at least three spaced holes of the first plurality of holes of the first beam align with three spaced holes of the first plurality of holes in the second beam at each of the discrete angles.

In a desired configuration of the structural framing unit, at least four generally equally spaced holes of the first plurality of holes in the first beam align with four generally equally spaced holes in the first plurality of holes of the second beam at each of the discrete angles. More desirably, less than 25 holes of the first plurality of holes in the first beam align with less than 25 holes in the first plurality of holes of the second beam at each of the discrete angles. In still further preferred embodiments, less than 20 holes of each of the plurality of holes in the two beams align at each of the discrete angles, and less than 15 holes of each of the first plurality of holes in both beams align at each of the discrete angles. In one preferred embodiment, both the first and second beams further comprise a second center hole along their respective longitudinal axes, and a second plurality of outer holes is positioned in a second arrangement about the second center hole. Each of the second plurality of outer holes is sized and shaped to receive a screw. Additionally, it is desirable that less than 25 holes of the first plurality of holes of the first beam align with less than 25 holes of one of the first and second plurality of holes of the second beam at each of the discrete angles.

Figure 1:
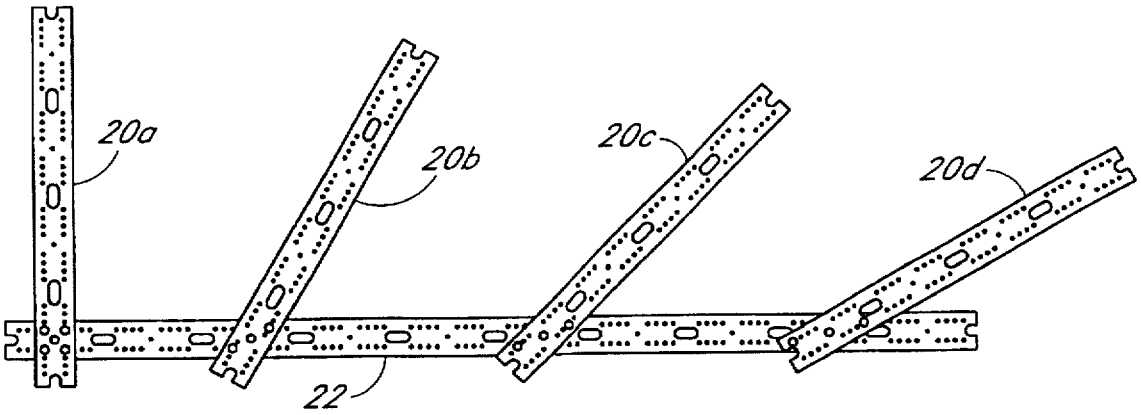
FIG. 1 (PRIOR ART)
FIG. 1 is a side elevational view of a prior art system of joining several structural elements with nuts and bolts.
Figure 2:
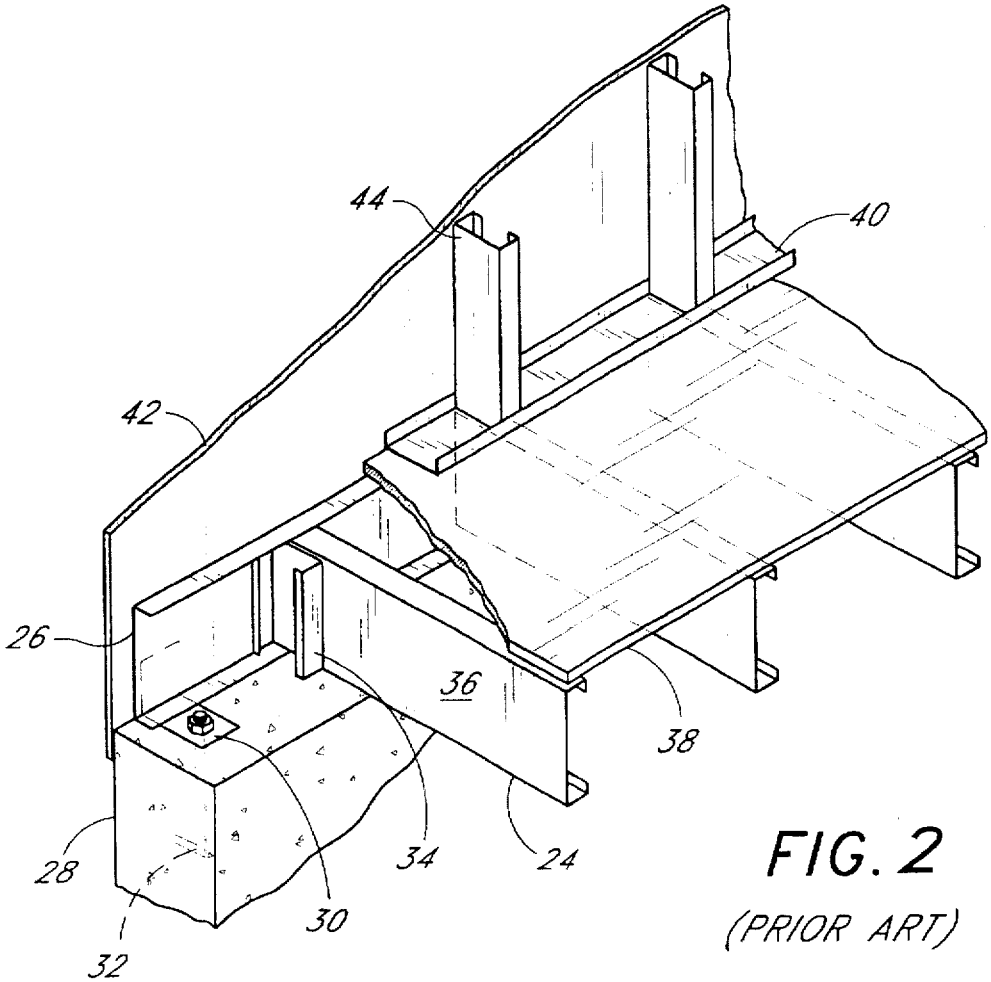
FIG. 2 (PRIOR ART)
FIG. 2 is a perspective view of a prior art floor framing system.
Figure 3:
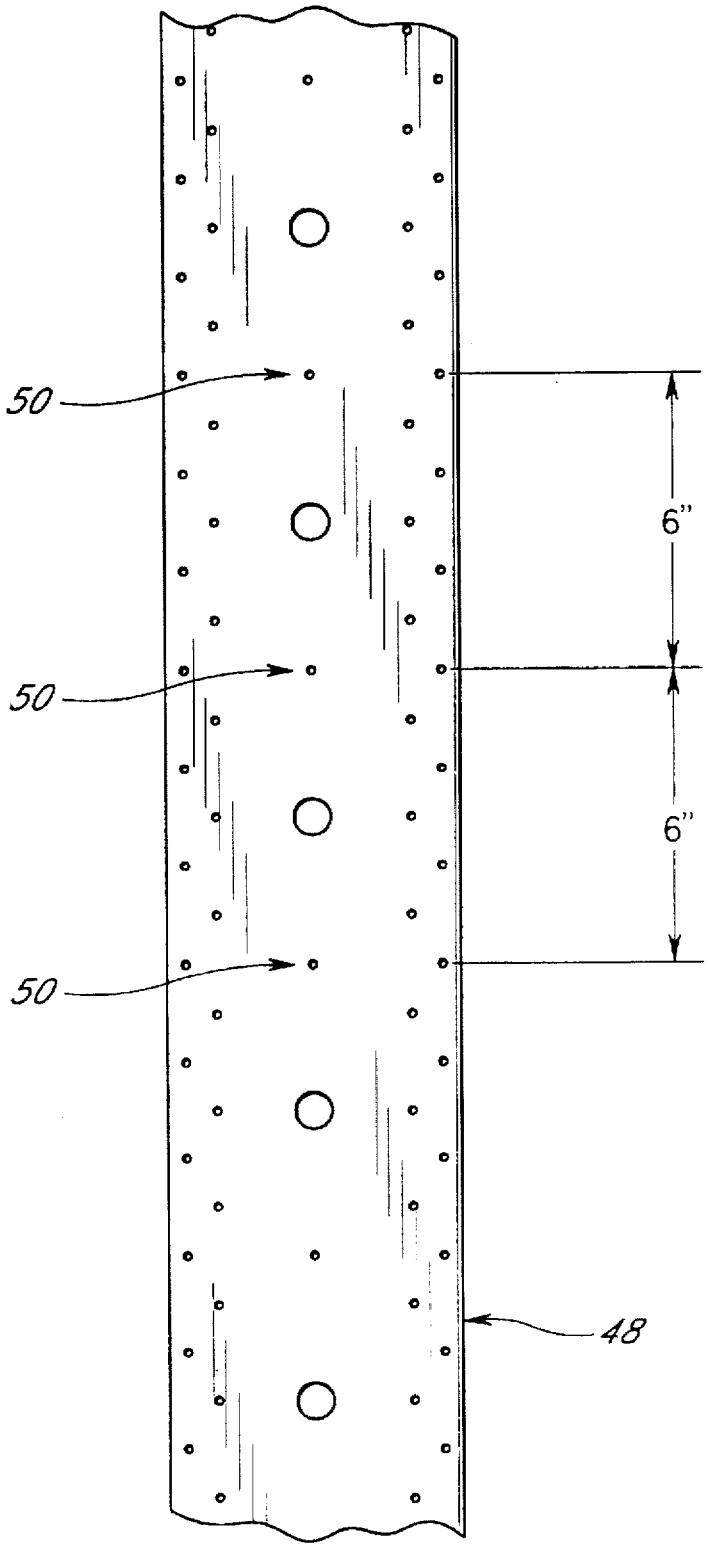
FIG. 3 (Prior Art)
FIG. 3 is a top plan view of a structural beam of the prior art having prepunched holes.
Figure 4:
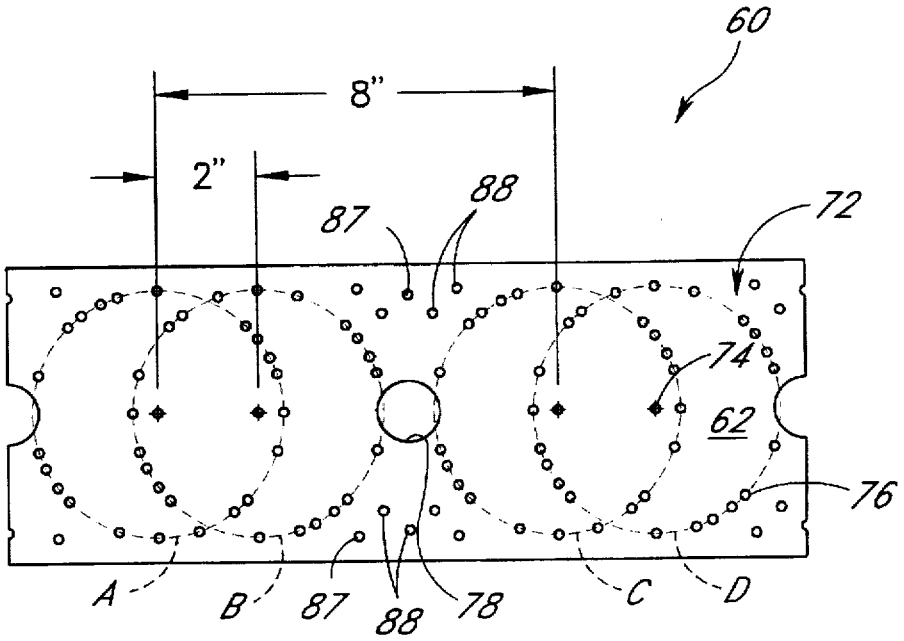
FIG. 4 is a top plan view of a structural beam of the present invention having a preferred pattern of prepunched holes.
Figure 5:
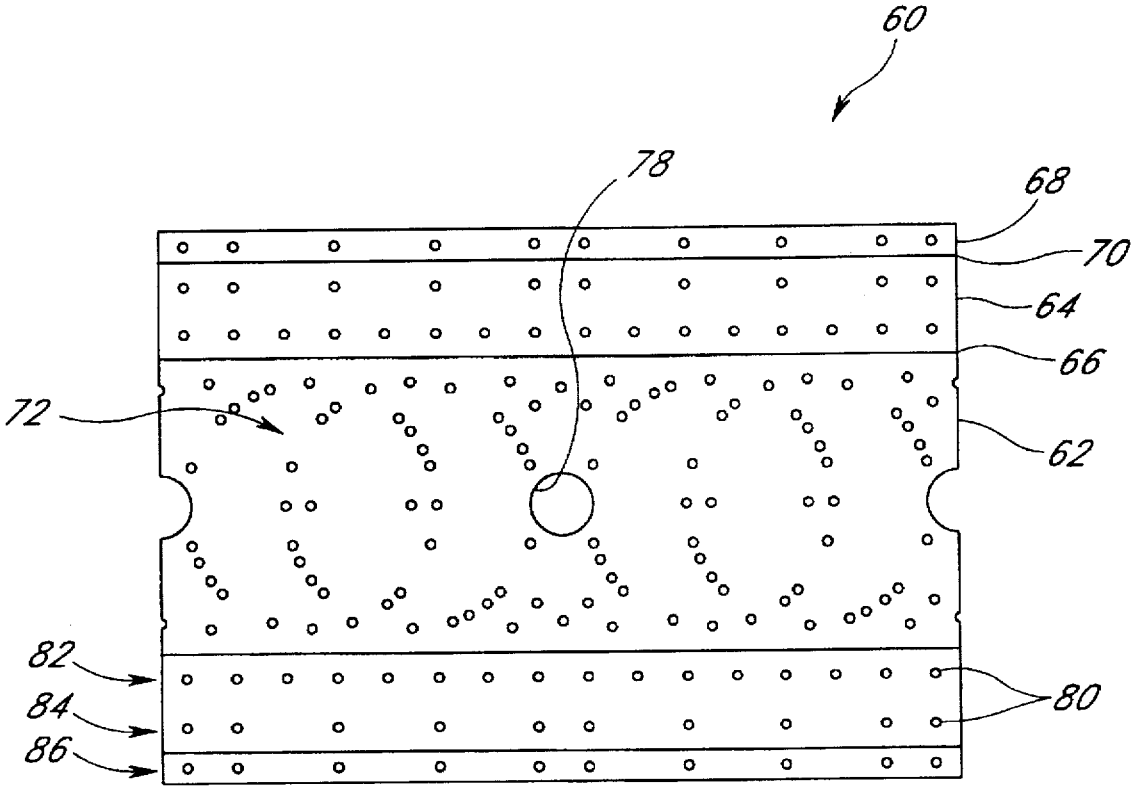
Figure 6:
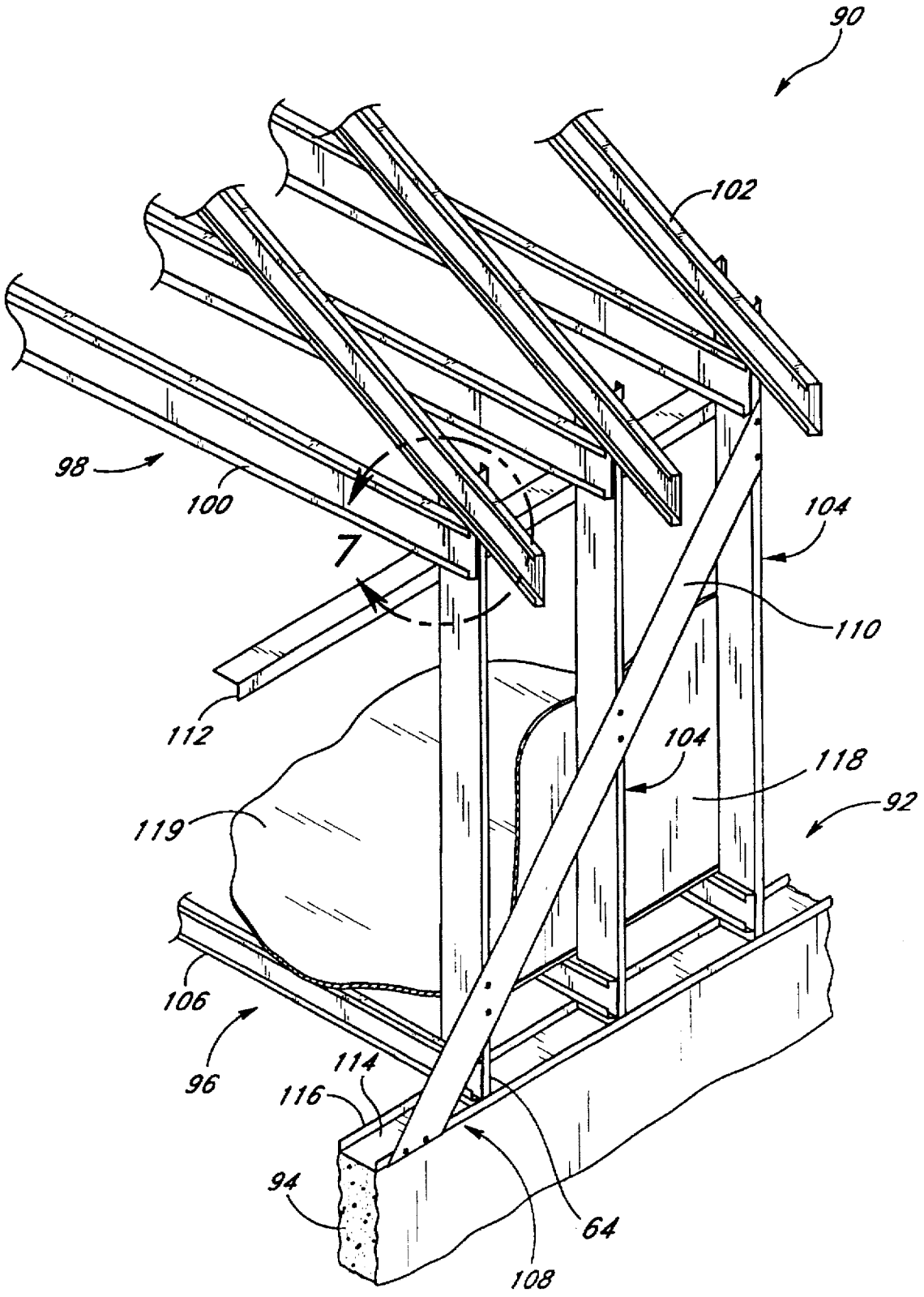
Figure 7:
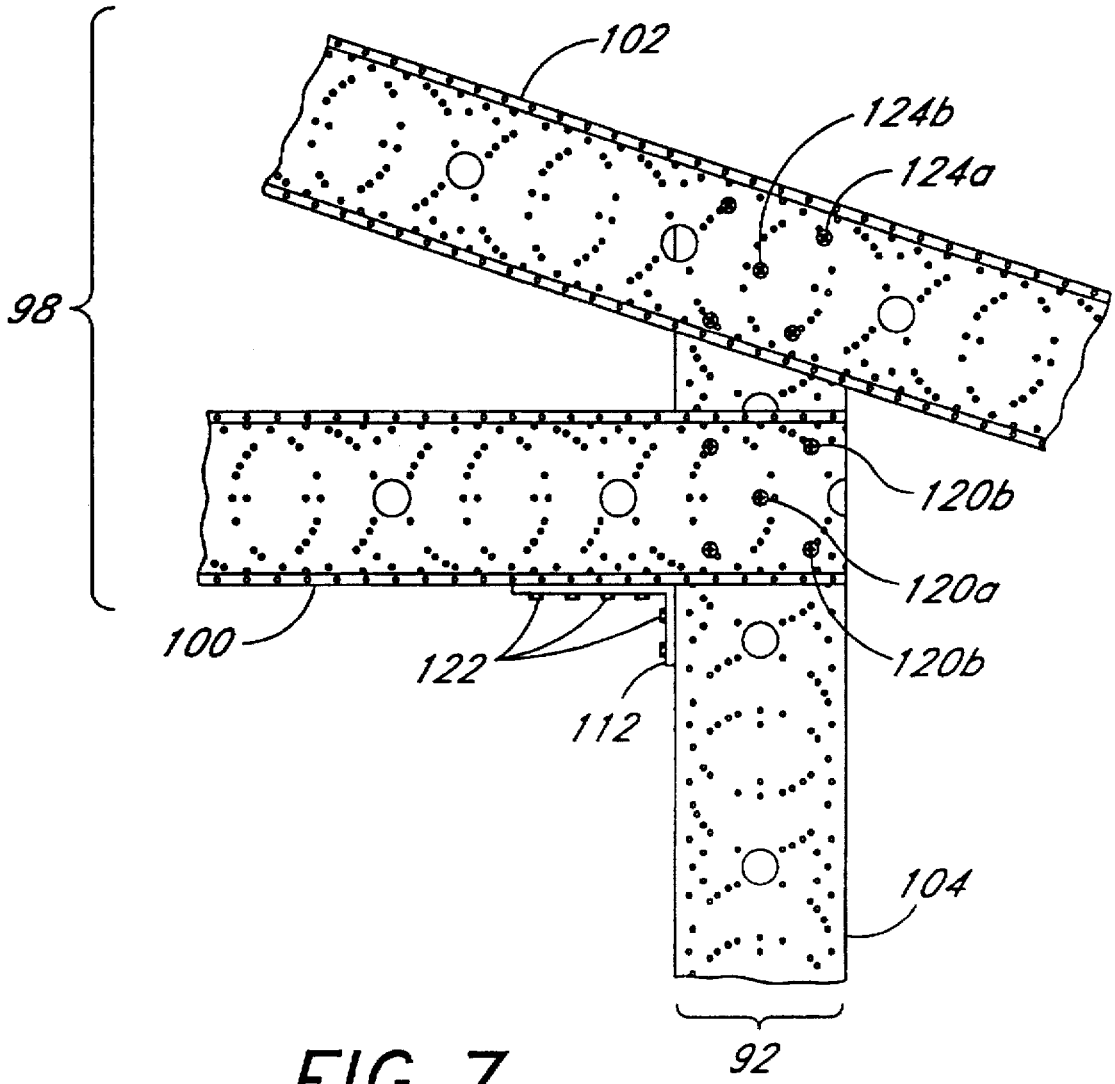
Figure 9:
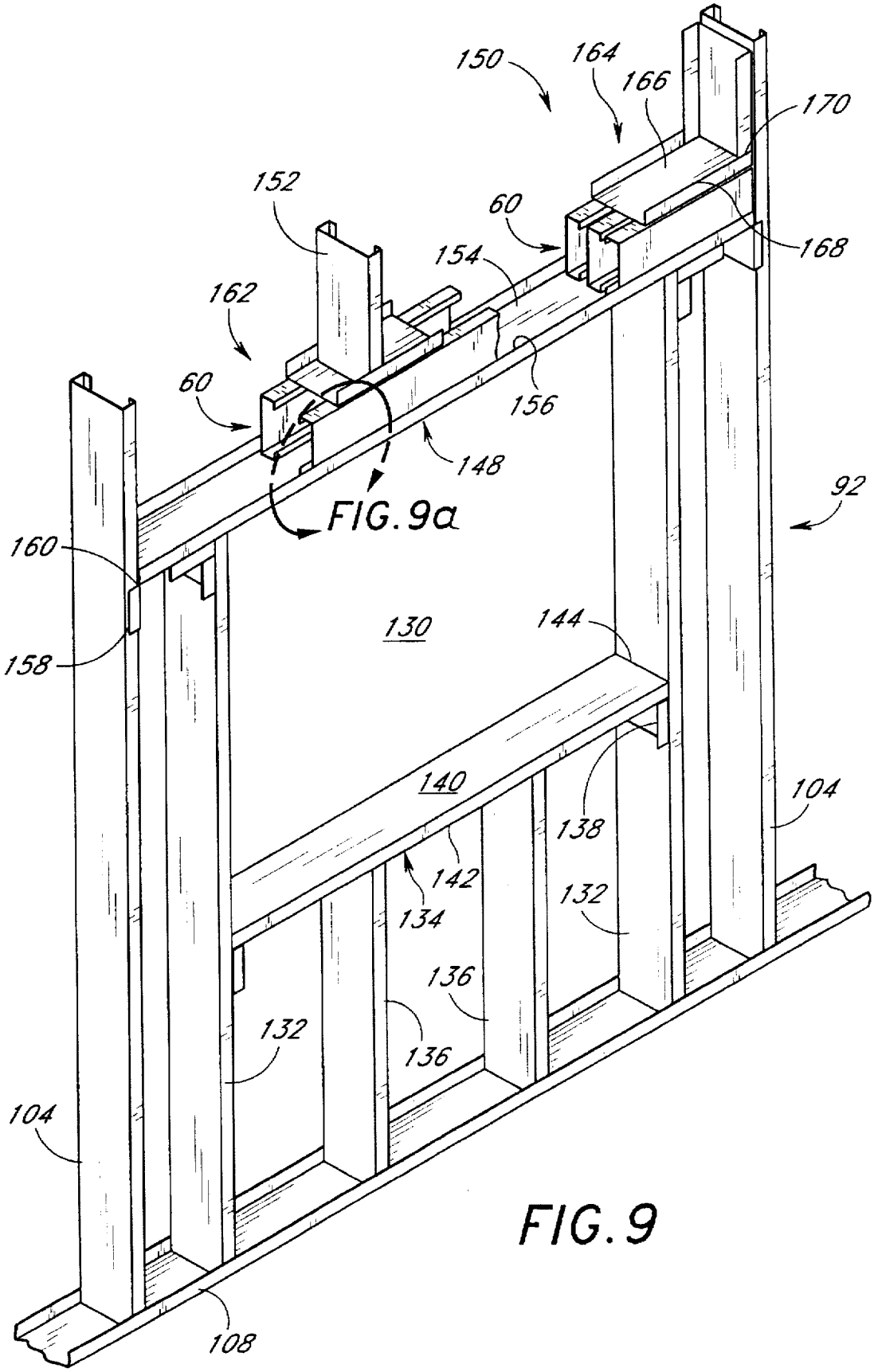
Figure 9A:
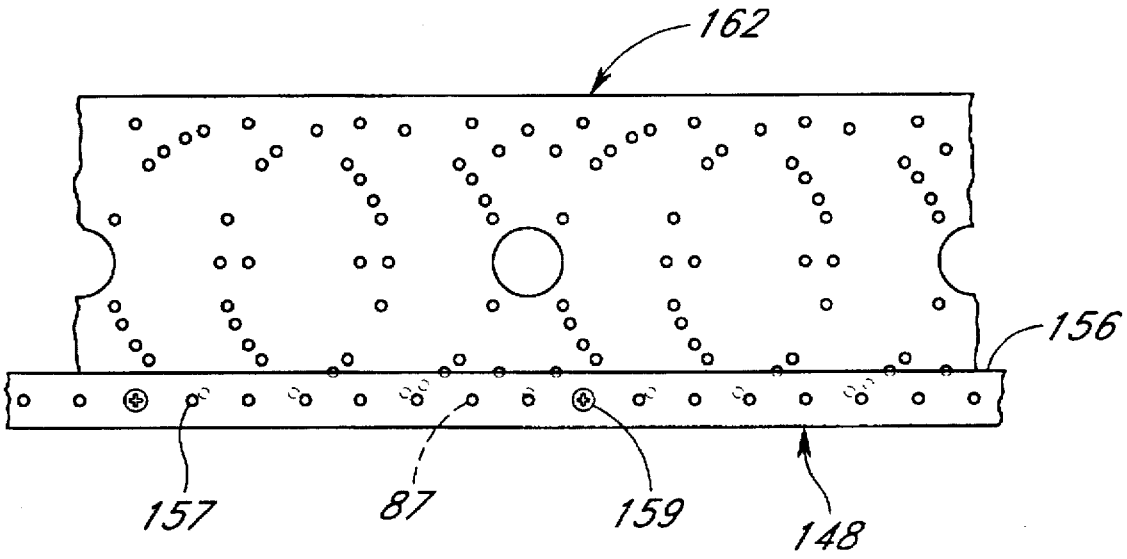

FIG. **4*a* is a detailed view of a portion of the structural beam shown in FIG. 4**;

FIG. 5 is a plan view of the structural beam of FIG. 4, shown prior to being shaped, so that the flanges of the C-channel are flat;

FIG. 6 is a perspective view of the exterior of a building utilizing the inventive features of the present invention;

FIG. 7 is a side elevational view of the detail, indicated at 7 in FIG. 6, showing the connection between the vertical wall studs and the structural beams of the roof;

FIGS. 8a–8h are side elevational views showing various positions in which two structural beams of the present invention can be connected;

FIG. 9 is a perspective view of a frame for an exterior wall utilizing the present invention;

FIG. 9a is a side elevational view of the detail, indicated at 9a in FIG. 9, illustrating the aligned holes for connecting a window header and a flange of a receiving track; and FIGS. 10a–10d are sectional views through structural members of the present invention joined together to form compound structural members.

DESCRIPTION OF THE PREFERRED EMBODIMENTS

The present invention greatly facilitates the construction of steel framing systems through the use of innovative structural elements particularly adapted for use in an improved framing system. The framing system makes use of only four different shapes of steel members. In a preferred embodiment, 20-gauge steel is used for all load-bearing components of the framing system, but other thicknesses of steel may be used as will be apparent to one of skill in the art. Furthermore, numerous connecting members are eliminated in the framing system of the present invention. To accomplish this, an innovative structural beam 60, shown in FIG. 4, includes a novel preformed hole pattern therein for facilitating direct connection between beams.

FIG. 4 is a top plan view of the innovative structural beam 60 so that only a planar rectangular web 62 is seen, while FIG. 5 illustrates the hole pattern and components of the structural beam 60 before it is shaped. The web 62 defines an outer surface as seen in FIG. 4 and an opposite inner surface. The rectangular web 62 includes opposed longitudinal sides and opposed terminal ends. The beam 60 is formed into C-channel shape, as can best be seen in the end view of FIG. 10a. Thus, the beam 60 includes the aforementioned web 62 joined to a pair of side flanges 64 at bend lines 66, and a pair of lips 68 extending parallel to the web 62 from the terminal ends of the flanges 64. The flanges 64 form 90° angles with the central web 62 and the lips 68, in turn, form 90° angles with the flanges 64.

In a preferred embodiment, the structural beam 60 comprises a web 62 having a width of approximately 6", flanges 64 of approximately 2" in width, and lips 68 of approximately ⅝" in width. The beams 60 may be formed in any desirable length, but are preferably severed along lines through intermittently spaced conduit apertures 78. Although other thicknesses may be used, the steel used for forming the structural beam 60 is preferably 20-gauge.

Figure 4A:
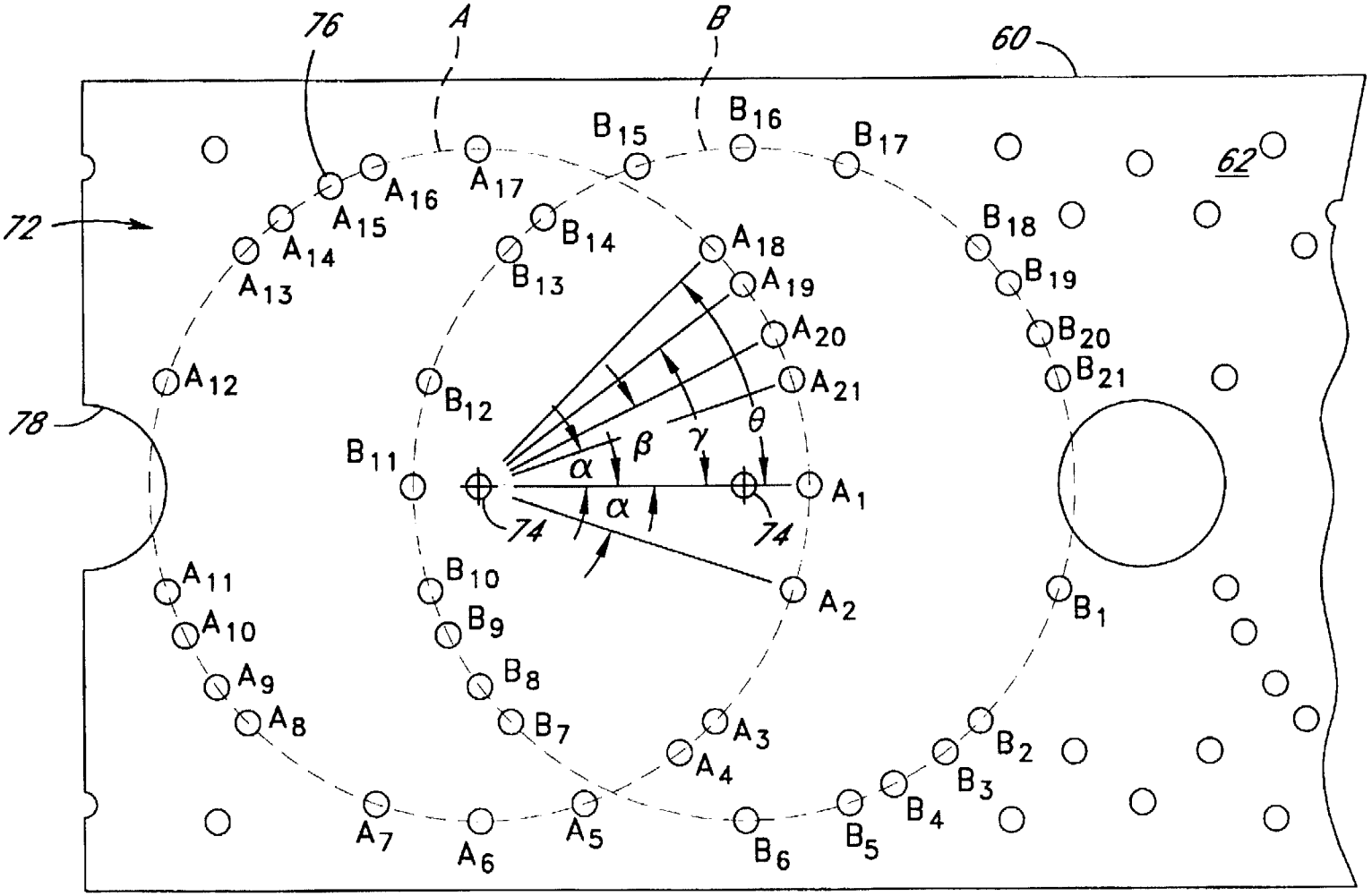

With specific reference to FIGS. 4 and 4a, the web 62 has a plurality of spaced hole patterns 72 formed therein. Each hole pattern 72 includes a center hole 74 and a plurality of outer holes 76 radially distributed around the center hole in a circle. In the illustrated embodiment there are twenty-one outer holes 76 surrounding the center hole 74. Where two structural beams 60 exhibit the hole pattern 72, the beams can be easily connected together at varying angles, as will be described in detail below.

The structural beam 60 includes a plurality of the conduit apertures 78 preferably spaced at 8" intervals along the beam 60 which provide access holes for electrical wiring and pipes through the frame. FIG. 4 illustrates the preferred spacing between the hole patterns 72. Specifically, four hole patterns A, B, C, and D are illustrated spaced along the longitudinal direction of the beam 60. As mentioned above, each of the hole patterns A–D includes a center hole 74, and the spacing between the hole patterns will thus be described with respect to the distance between each center hole. The distance between hole patterns A and B is 2", the distance between hole patterns B and C is 6", and the distance between hole patterns C and D is 2". The pair of hole patterns A and B is spaced from the pair of hole patterns C and D by 8". That is, the hole pattern A is spaced from the hole pattern C by 8", while the hole pattern B is spaced from the hole pattern D by 8".

Now with reference to the detailed view of FIG. 4a, the individual hole patterns 72 on each beam 60 will be more fully described. As can be readily seen, the outer holes 76 are distributed in a circular pattern around each of the center holes 74. Looking at the left-hand hole pattern A, the twenty-one outer holes begin at three o'clock at hole $A_1$ and continue around in a clockwise direction until hole $A_{21}$ at approximately two o'clock. Likewise, the hole pattern B includes twenty-one outer holes $B_1$ through $B_{21}$ in similar orientations. It will also be seen that the outer holes 76 in each of the patterns A or B are not evenly distributed around the circle. That is, hole $A_1$ is spaced from adjacent hole $A_2$ by an angle $\alpha$ around the circle. Likewise, $A_1$ is spaced from hole $A_{21}$ by the same angle $\alpha$ in the opposite direction. Looking further in the counterclockwise direction, $A_1$ is spaced from hole $A_{20}$ by an angle $\beta$, from hole $A_{19}$ by an angle $\gamma$, and from hole $A_{18}$ by an angle $\theta$. These angles are as follows: $\alpha$=18.43°, $\beta$=26.57°, $\gamma$=36.87°, and $\theta$=45°, and correspond to the angles typically utilized in roofing systems. Roof slopes or pitches are conventionally indicated by calling out the rise over the run in inches. That is, the angle $\theta$ corresponds to a roof having a slope of 4/12 or a rise of 4" over a run of 12". Likewise, $\beta$ corresponds to a roof slope of 6/12, $\gamma$ corresponds to a roof slope of 9/12, and $\theta$ corresponds to a roof slope of 12/12.

The preferred distribution of the outer holes 76 dictates that almost all have a corresponding outer hole diametrically opposed across the circular pattern of holes 72. That is, for example, hole $A_2$ is diametrically opposed from hole $A_{12}$, and hole $A_3$ is diametrically opposed from hole $A_{13}$, etc. Three of the holes around the pattern 72 have no counterpart diametrically opposed across the circle, namely holes $A_1$, $A_7$, and $A_{15}$. The counterpart for hole $A_1$ would be located on the circle within the large circular conduit aperture 78. As for holes $A_7$ and $A_{15}$, the adjacent circular hole pattern B intersects the circular pattern A at locations which would create a partial overlap between holes in each pattern. That is, a hole in pattern A formed between holes $A_4$ and $A_5$ would overlap with a hole in pattern B formed between holes $B_6$ and $B_7$. Likewise, a hole formed between holes $A_{17}$ and $A_{18}$ would conflict with one formed between holes $B_{14}$ and $B_{15}$. Thus, rather than favor one hole pattern over the other, these four conflicting holes in the two adjacent patterns A and B have been removed.

Another particular feature of the hole pattern 72 is their grouping around each circle. The outer holes 76 are grouped to be identical in the opposed quadrants of the circle. That is, each quadrant includes a grouping of four (or, in some cases, three) holes and a separate hole. The four quadrants here are distributed between the intersecting horizontal and vertical axes. For example, in the quadrant between the conduit aperture 78 and hole $A_{17}$, hole $A_{12}$ is singly disposed, and holes $A_{13}$ through $A_{16}$ form a group of four related holes. All of the outer holes 76 are oriented around the circle with respect to one of the horizontal or vertical axes. More particular, hole $A_{12}$ is oriented in a clockwise direction an angle $\alpha$ with respect to the horizontal axis. Holes $A_{13}$ through $A_{16}$ are oriented in a counterclockwise direction with respect to the vertical axis. That is, hole $A_{16}$ is disposed an angle α from the vertical, hole $A_{15}$ is disposed an angle β from the vertical, hole $A_{14}$ is disposed an angle γ from the vertical, and hole $A_{13}$ is disposed an angle θ from the vertical. The particular arrangement of these outer holes 76 will become more clear during the discussion of the connection between two beams 60, described below with reference to FIGS. 8*a*–8*h*. Of course, as mentioned above, two of the four quadrants are missing one hole each due to the interference with the adjacent circular hole pattern.

FIG. 5 illustrates the C-channel beam 60 in its preformed stage. The beam 60 starts out as a flat strip of metal in which the various holes are punched. The hole patterns 72 in the web 62 have been described previously. A plurality of side connector holes 80 are formed in the flanges 64. A first row of side connector holes 82 is formed adjacent the bend line 66. This first row 82 includes multiple holes 80 spaced from the adjacent hole by approximately 1". A second row of holes 84 is formed in the flange 64 adjacent to the second bend line 70. The second row 84 includes holes 80 spaced from the adjacent hole by 1" or 2". A third row of holes 86 is formed in each of the lips 68. The holes in the third row 86 are spaced apart the same distance as the holes in the second row 84. The various connector holes 80 in both the flanges 64 and lips 68 are used in constructing the light gauge steel framing system, as will be more fully described below. Advantageously, the alternating 1" and 2" spacing between the connector holes 80 in the second and third rows 84, 86 provides added convenience by increasing the variations of spacing between fasteners used in connecting the beams 60 to other elements of the framing system.

FIGS. 4 and 5 also illustrate two sets of five holes on each lateral side of the beam webs 62 adjacent each conduit aperture 78. Specifically, two locator holes 87, one on each side of the aperture 78, lie along a line perpendicular to the flanges 64 and through the aperture. These holes 87 assist in locating a cut across the beam 60 through the center of the aperture 78. The remaining four holes 88, four on each side of the aperture 78, provide locations for fastening the web 62 to a flange of a track member, for example. It will be appreciated that each of the holes 88 is located within one inch strips on either side of the line through the conduit apertures 78 and locator holes 87.

FIG. 6 illustrates a portion of an innovative steel framing system 90 incorporating the innovative structural beams 60 of the present invention. In part, the framing system 90 includes a vertical wall 92 constructed over a foundation 94, a horizontal floor 96 extending inward from a lower portion of the wall 92 and a roof 98 comprising a plurality of horizontal roof joists 100 and angularly disposed roof rafters 102. The wall 92 is primarily constructed of a plurality of vertically disposed studs 104. The floor 96 is primarily constructed of a plurality of horizontal floor joists 106. Each of the roof joists 100, roof rafters 102, wall studs 104 and floor joists 106 comprise the previously-described structural beams 60. That is, each of the structural beams is a C-channel steel member having the preferred hole pattern 72 formed in its web 62, flanges 64 and lips 68.

The vertical wall 92 comprises a base track 108 bolted to the foundation 94, the vertical studs 104, a plurality of angularly disposed cross braces 110, and an upper L-angle member 112. The base track 108 is formed with a web portion 114 and a pair of outer flanges 116. The spacing between the outer flanges 116 is slightly greater than the distance between the flanges 64 in the structural beam 60 forming the wall studs 104. In a preferred embodiment, the base track 108 has a dimension across its web 114, within the flanges 116, of approximately 6" Thus, the lower ends of the wall studs 104 fit snugly within the base track 108. The flanges 116 have a width of approximately 1" The base track 108 is preferably formed from the same gauge of steel as the structural beam 60. Fasteners are used to attach the flanges 116 on the track 108 and the flanges 64 on the wall studs 104.

In an important feature of the present framing system, preformed holes are provided in the web 114 and flanges 116 which align with corresponding holes in the beams 60. For ease of manufacture, and to simplify the assembly process, the track 108 is formed on the same line as the beams 60. An approximately 8 inch wide strip of sheet is fed into the roll punches which form the same hole patterns as in the beams. Thus, the central 6 inch wide web 114 exhibits the exact same pattern of holes as the web 62 of the beams. The flanges 116 receive the same hole pattern as the flanges 64 in the beams 60, albeit along only a one inch wide strip. Shims are used to create a larger radius of bend between the web 114 and flanges 116, so that the track flanges are slightly wider than the beam flanges 64 and the holes in the track flanges line up with corresponding holes in the beam flanges.

An inner wall board 118 attaches to the inside surface of the wall studs 104. At the upper end of the wall 92, the vertical studs 104 are joined together with the L-angle 112. The L-angle 112 preferably comprises a member having two legs, one leg approximately 2" and one leg approximately 4". In the embodiment of FIG. 6, the longer leg of the L-angle 112 extends horizontally underneath the ceiling joists 100. The L-angle ties up the structure at the top and is primarily responsible for picking up structural drag through the entire framing structure.

The L-angle 112 has a plurality of preformed holes in each of two legs disposed 90° from each other, the holes adjacent the inner surface of the wall studs 104 aligning with the connector holes 80 in the flanges 64. As with the track 108, the holes in the L-angle 112 are preferably formed in the same pattern as the beams 60. In this respect, the L-angle 112 is formed on the same line as the beams 60. An approximately 6 inch wide strip of sheet is fed into the roll punches so that four inches of the strip extends across the middle section used to form holes in the 6 inch wide beam web 62. The four inch portion thus exhibits the exact same pattern of holes as the web 62 of the beams, and is just wide enough to include the conduit holes 78. The remaining two inch portion has holes punched therein to match the beam flanges 64, and is then bent at 90° to the four inch portion. The continuous strip is then severed into the individual L-angles 112. In this manner, the holes in the L-angle 112 match those of the beams 60, and track 108 for that matter.

The angled cross braces 110 are simply flat strips of the same gauge steel as the beams 60 which have a plurality of holes formed therein for attaching to both the base track 108 and a plurality of the vertical wall studs 104. The specific arrangement of holes in the cross-braces desirably matches those formed in the structural beams 60. That is, a six inch wide strip of metal is fed into the roll punch to form the same holes as in the central web 62 of the beams 60. The cross braces 110 provide stability for the wall structure 92 by picking up much of the transverse loading imposed on the walls 92 and are particularly important in regions with regular seismic activity. The braces 110 are typically utilized on the ends of structures and may be formed from the same gauge of steel as the beams 60 or with a different gauge based on engineering specifications.

The floor structure 96 comprises a plurality of the parallel floor joists 106 attached at their ends to a lower portion of the wall studs 104. The wall studs 104 are typically spaced either 16" or 24" apart. A plywood subfloor 119 is then fastened over the floor joists 106.

The roof 98 comprises a plurality of the parallel horizontal roof joists 100 attached at either end to upper portions of the wall studs 104. Preferably, the roof joists 100 are attached just above the L-angle 112 so that the joists may be coupled to the L-angle. Finally, the roof rafters 104 are rigidly attached to the uppermost portion of the wall studs 104 at a desired roof angle.

FIG. 7 illustrates one preferred connection between the wall 92 and roof 98. As mentioned, the roof joist 100 attaches to an upper portion of the wall stud 104 at a 90° angle. Five fasteners 120*a*, 120*b* are utilized for the connection between the roof joist 100 and wall stud 104. As can be seen, a center fastener 120*a* and four outer fasteners 120*b* are used. The fasteners 120*b* are preferably oriented in a square surrounding the center fastener 120*a*. In the particular orientation shown in FIG. 7 there are two aligned holes in each quadrant of the juxtaposed circular hole patterns 72 in the vertical wall stud 104 and the horizontal ceiling joist 100. The four fasteners 120*b* around the circular pattern are shown inserted through four selected holes, although others may be utilized. The important consideration from a strength perspective is that four approximately evenly distributed fasteners around the circular hole pattern 72 are used. However, it is not critical that the pattern form a perfect square orientation.

The L-angle 112 is shown attached to both the wall stud 104 and roof joist 100 with fasteners 122. Again, these fasteners 122 extend into the flanges 64 of the structural members 60. Finally, the roof rafter 102 is shown rigidly attached to an upper portion of the wall stud 104 with five fasteners 124*a*, 124*b*. The roof rafter 102 is illustrated at a 4/12 roof slope with respect to the vertical wall stud 104. In this orientation and with the beams configured as shown in FIG. 7, the four outer fasteners 124*b* cannot be located in a perfectly square pattern. However, the installer can locate the fasteners 124*b* in approximately an even distribution about the center fastener 124*a* in the circular hole pattern 72.

The fasteners are advantageously standard sharp-pointed screws. The provision of the rotating hole pattern 72 eliminates the need for expensive self-drilling Tek screws. Moreover the time-consuming process of clamping each connection is replaced with rapid insertion of the screws through the pre-formed, aligned holes.

The structural beams 60 are formed having a C-shaped cross-section for enhanced strength. In particular, the C-shaped beams 60 have a large strength in bending or torsion relative to the amount of material in cross-section from the channel shape. Connection of two or more beams 60 at their webs 62 or in other arrangements even further increases the strength. In short, the ability to easily connect the strong C-shaped structural members of the present invention in a variety of configurations because of the innovative hole pattern and assembly method is a great asset to steel framers.

Moreover, the C-shaped beams 60 are relatively inexpensive and simple to manufacture. As mentioned above with reference to FIG. 5, the beams 60 begin as flat sheets within which the predetermined hole patterns 72 and various connector and conduit holes are punched. The sheets are then bent at the lines 66, 70 using a series of rollers. A number of techniques for forming the final C-shaped beams 60 are well known in the art and will not be discussed further herein.

An important aspect of the present invention is the ease and rapidity of the process of connecting two beams 60 at a variety of angles. Center holes 74 in each web 62 of two beams 60 are aligned and a sharp-pointed screw inserted but not tightened all the way. The two beams 60 can then be rotated so that their respective circular hole patterns 72 centered at the point of connection coincide. Specifically, one beam 60 may be rotated with respect to the other until there are at least four outer holes 76 aligned. Fasteners are then inserted through the aligned four outer holes 76. Importantly, for any of the various rotational alignments, five fasteners can be used between the beams 60. Advantageously, the spatial arrangement of the five fasteners is maintained generally constant for any orientation between two beams 60. That is, the five fasteners are distributed, one in the center and four radially disposed about the center in a square pattern, as described above. In some situations it will not be possible to align four outer holes 76 in a square arrangement, but the strength of the connection between the two beams will be approximately equal by inserting four fasteners through four of the generally equally spaced aligned outer holes 76. By providing preformed holes into which sharp point screws can be threaded, the surfaces of the juxtaposed webs 62 are in intimate flush contact for a uniformly strong connection.

To further speed connection between two beams 60, the center hole 74 in any one circular hole pattern 72 is relatively easy to locate. This is helpful both to speed assembly and prevent errors. Essentially, the center holes 74 of the hole patterns will be the two longitudinally central holes between the conduit apertures 78. The desired individual center hole can easily be identified as being the one of the longitudinally central holes nearest the left or right conduit aperture 78, as desired.

Specifically, between each conduit aperture 78 there are four holes on the centerline of the beam 60. Two of these holes are outer holes 76 in adjacent hole patterns 72, while the other two are the respective center holes 74. With reference again to FIG. 4, an outer hole 76 in hole pattern B is formed 2.5 inches from the center of the conduit aperture 78 on the left. The center hole 74 for the hole pattern A is formed 0.5 inches to the right, and the center hole 74 for the hole pattern B is formed 2.0 inches further to the right. Finally, an outer hole 76 in hole pattern A is formed 0.5 inches to the right of the center hole 74 for the hole pattern B, and 2.5 inches from the center of the next conduit aperture 78 to the right. The center holes 74 are thus identified as being the two closest together between the conduit apertures 78. (Alternatively, the holes 74 could be identified by virtue of being spaced apart 2.0 inches.) It is then a simple matter to identify the desired center hole 74 based on whether the hole pattern closest to the right or left conduit aperture 78 is desired. Thus, the installer has a simple task of aligning the desired center holes 74 for the respective beams, after which the remaining outer holes can be lined up by simply rotating one beam with respect to the other.

The particular spacing between the outer holes 76 around the hole pattern is designed to facilitate assembly of two beams 60 together. Alternatively, thirty-two spaced holes might be provided around each of the hole patterns, with four holes corresponding to the standard roof slopes distributed in both clockwise and counterclockwise directions from each of the horizontal and vertical axes intersecting the circular pattern. However, this might compromise the structural strength in torsion of the connection. The preferred hole pattern illustrated in FIG. 4*a* allows for the four outer holes 76 to be aligned with four holes in the second beam at any of the angular increments, but makes the identification of the target four holes much easier. Desirably, in all orientations there is never less than three outer holes 76 aligned between two beams 60, but never more than fourteen holes aligned. The use of four outer holes 76 and a central hole 74 for connection purposes ensures the strength of the connection. At the same time, because there are never more than fourteen holes aligned, the job of determining which holes receive fasteners is much easier. When fourteen or fewer holes are aligned between two beams 60, it is a relatively simple matter to identify four holes which are disposed in an approximate square around the circle. Furthermore, if the assembler miscalculates and does not find four holes which are disposed on an exact square, so long as the holes used are generally equally spaced around the circular outer hole pattern 76, the strength of the connection between the two beams will not be greatly reduced.

FIGS. 8*a*–8*h* illustrate the various angles at which one of the structural beams 60*a* may be attached to a second structural beam 60*b*. The top or first beam 60*a* is illustrated in phantom to expose the hole pattern 72 in the lower or second beam 60*b*. For purposes of illustrating the registry between the individual holes in the coincident hole patterns 72, the outer holes 76 in the first beam 60*a* are illustrated as open circles, while the outer holes 76 in the second beam 60*b* are shown as solid dots.

Figure 8A:
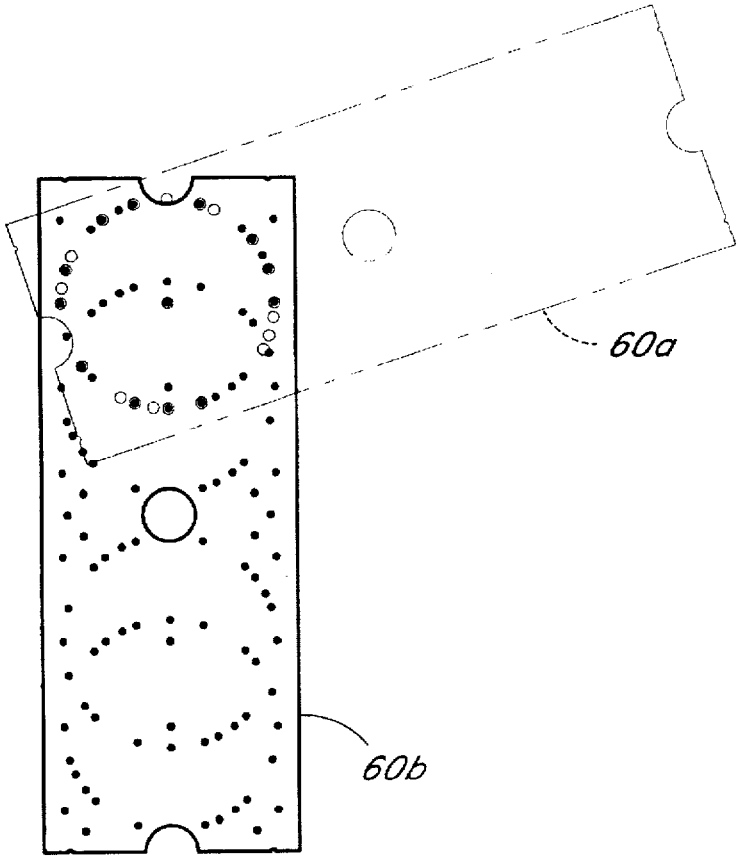
Figure 8B:
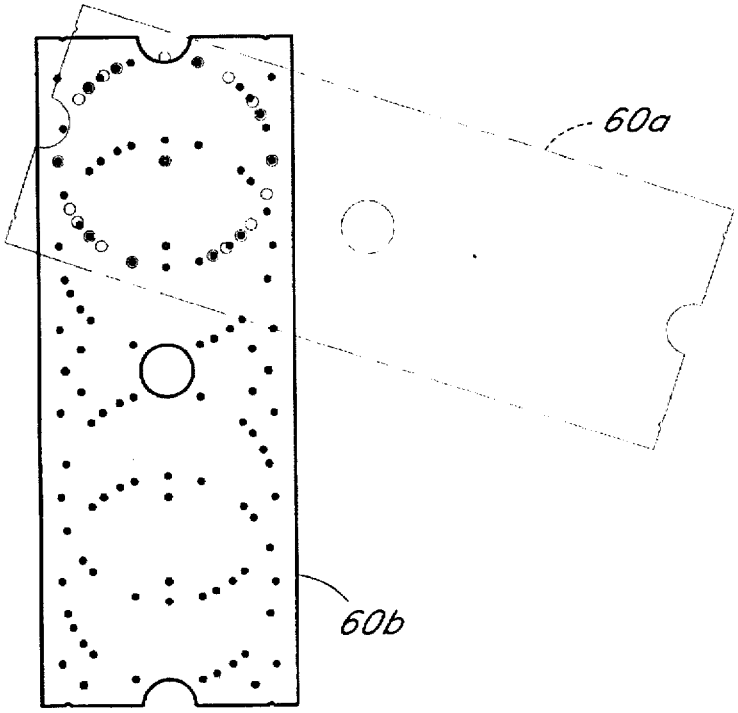

Referring to FIG. 8*a*, the first beam 60*a* has been rotated approximately 18.6° from a horizontal orientation in a counterclockwise direction to attach to the vertical second beam 60*b*. It can be readily ascertained that there is at least one hole in the first beam 60*a* aligned with a hole in the second beam 60*b* in each of the quadrants of the juxtaposed hole patterns. In FIG. 8*b* the first beam 60*a* has been rotated in a clockwise direction approximately 18.6°. Both FIGS. 8*a* and 8*b* correspond to slopes of 4/12. For such angular orientations, 10 holes align between the two beams 60*a,b*.

Figure 8C:
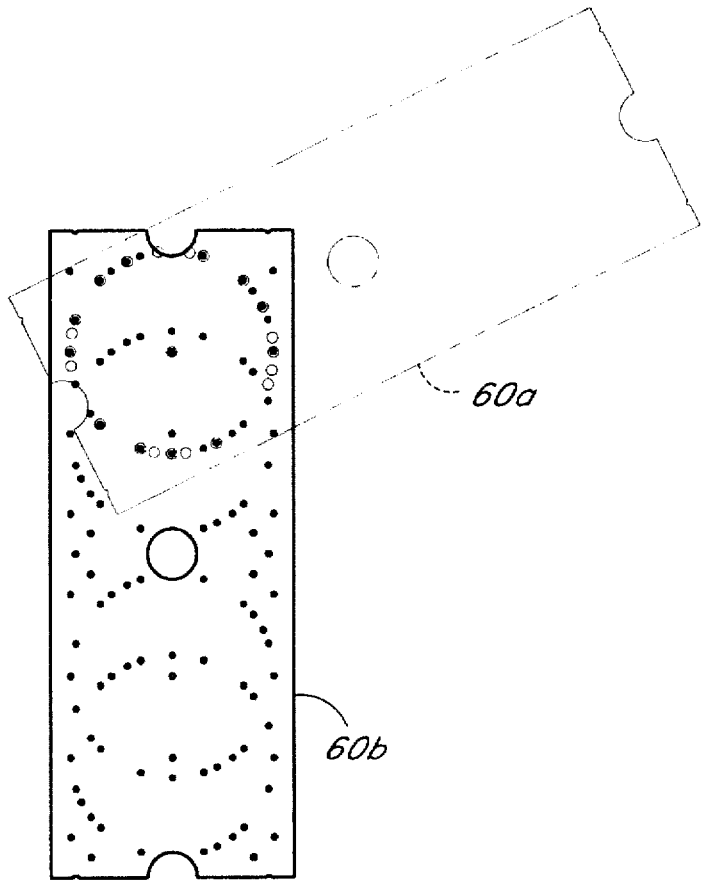
Figure 8D:
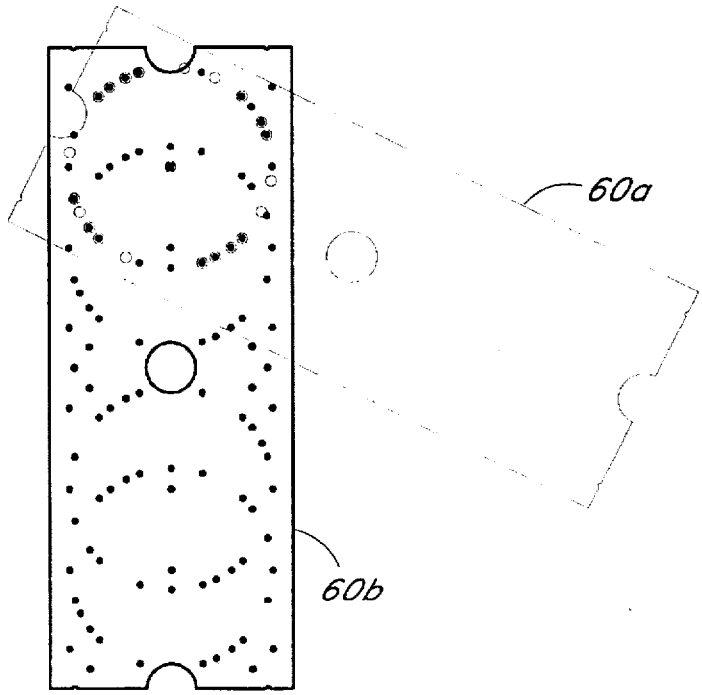

FIGS. 8*c* and 8*d* illustrate the first beam 60*a* attached to the vertical second beam 60*b* and oriented at angles of approximately 26.6° from the horizontal in the counterclockwise and clockwise directions, respectively. As will be apparent, the arrangement in FIG. 8*c* aligns twelve of the outer holes 76 between the hole patterns in the two beams. The arrangement shown in FIG. 8*d*, on the other hand, shows fourteen holes aligned around the hole patterns. Thus, a variety of combinations of aligned holes can be used for inserting fasteners. The angles of the first beam 60*a* with respect to the second beam 60*b* correspond to conventional roof slopes of 6/12, rise over run.

Figure 8E:
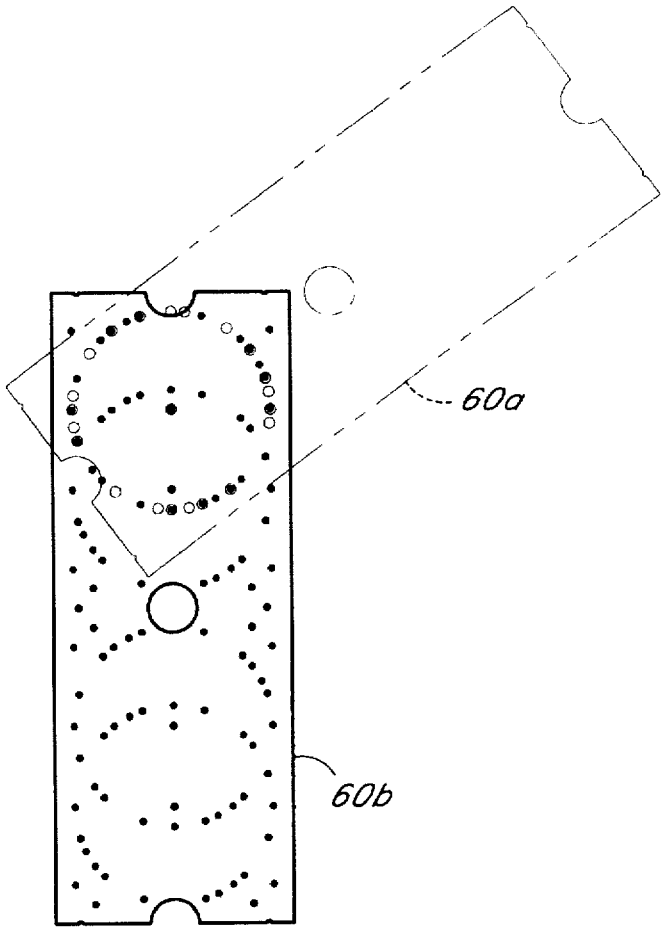
Figure 8F:
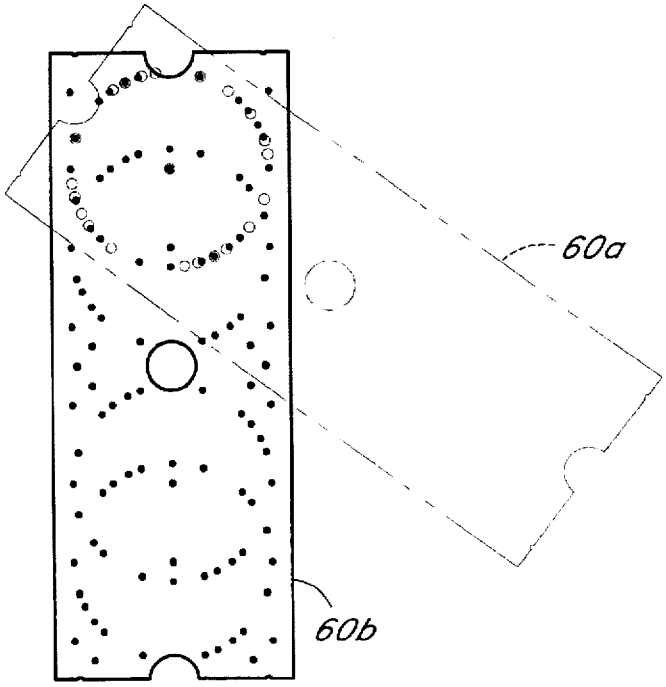

In FIGS. 8*e* and 8*f* the first beam 60*a* is disposed in the counterclockwise and clockwise directions, respectively, and attached to the vertical second beam 60*b*. The angle made by the first beam 60*a* is approximately 36.9° from the horizontal, corresponding to a conventional roof slope of 9/12. In the arrangement of FIG. 8*e*, ten of the outer holes 76 in the juxtaposed hole patterns 72 align, while in FIG. 8*f* only four of the outer holes align. In FIG. 8*f* a perfect square pattern of fasteners cannot be formed for connecting the first and second beams 60*a,b*. However, the strength of the connection will not be seriously undermined because four generally equally spaced fasteners are still utilized, as well as the center fastener.

Figure 8G:
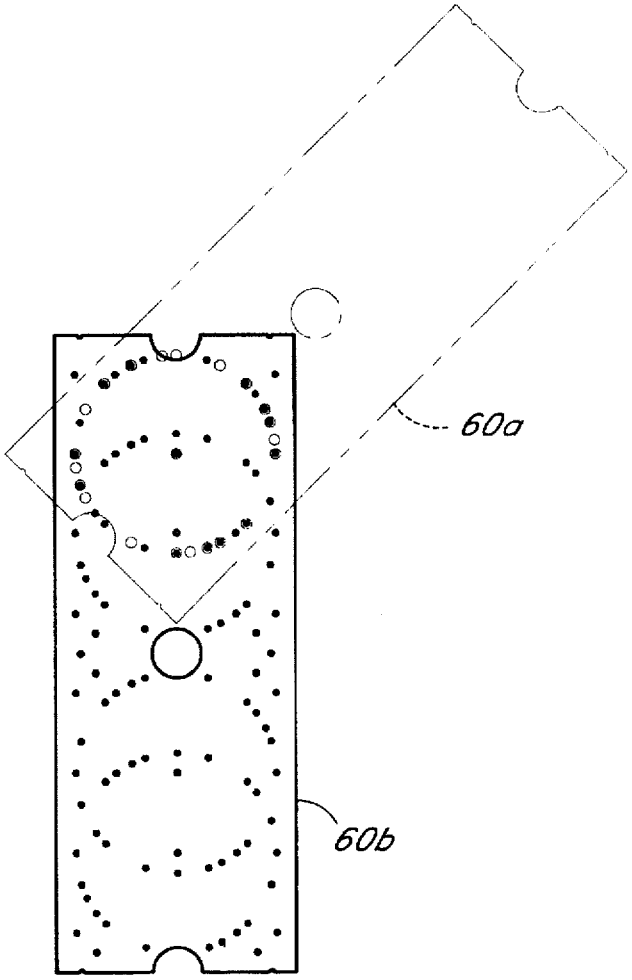
Figure 8H:
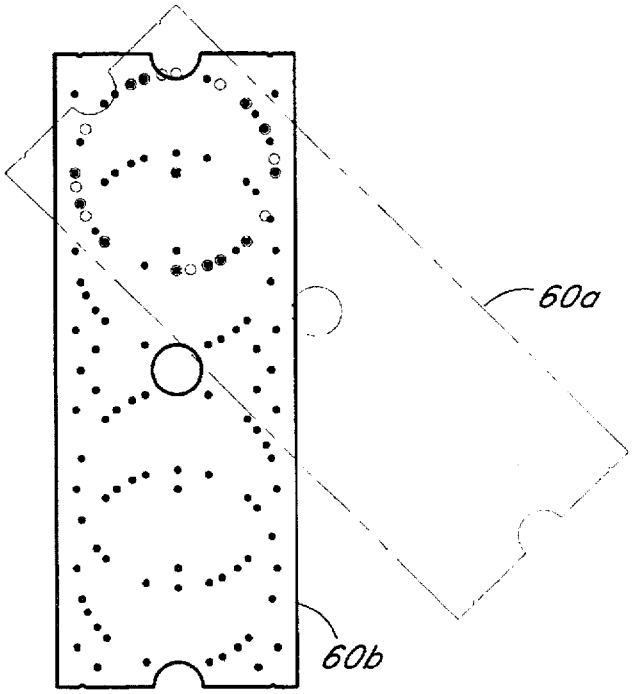

Finally, FIGS. 8*g* and 8*h* illustrate a first beam 60*a* disposed at both counterclockwise and clockwise 45° angles, respectively, from the vertical. These angles correspond to conventional steep roof slopes of 12/12. In both of these arrangements shown in FIGS. 8*g* and 8*h*, twelve of the outside holes 76 align between the juxtaposed circular hole pattern 72.

Referring back to FIG. 7, the lips 68 which extend inward on the beams 60 may extend inward to occlude one or more of the aligned holes in the circular hole pattern 72. In this situation it is preferred to insert the four fasteners in pairs of aligned holes which are not overhung by the lip 68 to enable the fasteners to be inserted in a co-axial manner to the holes to speed the assembly process. However, if this is not possible, the fasteners may be angled slightly to extend into any aligned holes which are occluded by the lips 68. The thickness of the juxtaposed webs 62 is such that the fasteners may be inserted and self-tap into these aligned holes at a slight angle without detrimentally affecting the strength of the connection.

Referring now to FIG. 9, a portion of a wall 92 incorporating a window 130 is illustrated in accordance with the innovative framing system and structural members of the present invention. It will be recognized that the discussion of the construction of the wall 92 surrounding the window 130 may be applied to the construction of a wall surrounding a door or other such discontinuity. To the sides of the window 130, the wall 92 is as described previously. That is, the wall 92 comprises the base track 108 having a plurality of vertical wall studs 104 attached thereto. The window frame is defined by a pair of parallel king studs 132 spaced slightly inwardly from the surrounding wall studs 104. A sill 134 extends horizontally between the king studs 132 to define a lower border of the window 130. A pair of cripples 136 extend vertically between the base track 108 and the underside of the sill 134. In this respect, the sill 134 is preferably formed from the track material 108 so that its downwardly depending flanges surround the cripples 136 and are attached thereto. The sill 134 attaches to each of the cripples 132 with short vertical end portions 138 formed integrally with the sill. More particularly, the sill 134 is defined by a web 140 and a pair of downwardly depending flanges 142. A bend line 144 is formed in the web 140, and the short vertical portions 138 extend downward therefrom. A rectilinear cutout must be formed in the flanges 142 adjacent the bend line 144 to accommodate this 90° bend. Although not shown, fasteners extend through the short vertical portion 138 and the web of the king studs 132.

The king studs 132 extend upward on either side of the window 130 and are capped by a portion of track 148 which receives a horizontal reinforced header 150. The header 150 extends between the outer vertical wall studs 104 and provides structural support for the roof load distributed downward through secondary cripples 152. The track portion 148 is defined by a web 154 and a pair of upwardly extending flanges 156. The track portion 148 attaches to both vertical wall studs 104 at short end sections 158 bent downward at 90° with respect to the middle portion of the track 148. In this respect, the flanges 156 are cut or snipped in a line down to the web 154 at 160. The web 154 can thus be bent, and the short section 158 wrapped around the inner surface of the wall studs 104. Fasteners (not shown) secure the short section 158 to the wall studs 104.

The header 150 fits within the track portion 148 and rigidly attaches to the wall studs 104. In FIG. 9*a*, the specific connection points between the header 150 and track portion 148 are shown. As described previously with respect to the base track 108, the track portion 148 is formed on the same assembly line and exhibits the same hole pattern as the corresponding portion of the structural beams 60. In particular, the upwardly extending flanges 156 have a line of connecting holes 157 formed therein which correspond to the line of connecting holes 82 formed in the flange 64 of the beam 60 (as seen in FIG. 5). The connecting holes 157 are spaced with respect to the bend between the web 154 and flange 156 the same distance as the locator holes 87 in the beam 60 are spaced from the bend line 66. The locator holes 87 are spaced apart two inches longitudinally while the connecting holes 157 are spaced apart one inch longitudinally so that intermittent holes may be aligned and fasteners 159 installed.

FIG. 9 illustrates two variations of headers: a first 6×6 header 150 illustrated at the upper right portion and a second 4×6 header 162 toward the middle of the track 148. The 6×6 header 150 is formed by three of the C-shaped structural beams 60 described above with respect to FIG. 4, 4*a*, and 5. The beams 60 are joined together at their lips and webs to form the aggregate header 150. An upper track portion 164 extends across the width of the header 150 or 162 and rigidly attaches to each of the wall studs 104. In this respect, the upper track portion 164 includes a web portion 166 and a pair of upwardly directed outer flanges 168. As is seen in the top right portion of FIG. 9, the flanges 168 of the upper track 164 have been cut out at 170 to allow the web 166 to be bent upward at 90°. The web 166 is then fastened to the wall studs 104, and also to the flanges 64 of the structural members 60 within the header 150.

The 4×6 header 162 is defined by two of the structural beams 60 spaced apart by the thickness of one of the beams. That is, the two beams 60 are fastened between the lower track 148 and the upper track 164 to define a space there between. Thus, the overall sizes of the headers 150 and 162 are the same, but the strength of the 6×6 header 150 is substantially greater.

Figure 10A:
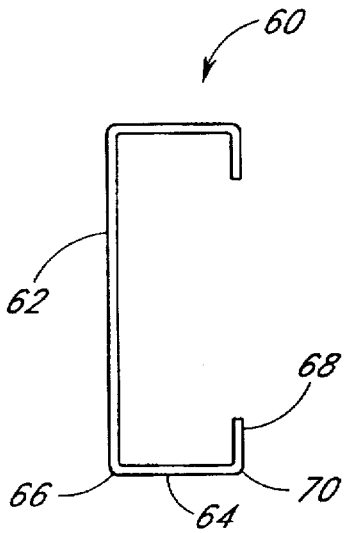
Figure 10B:
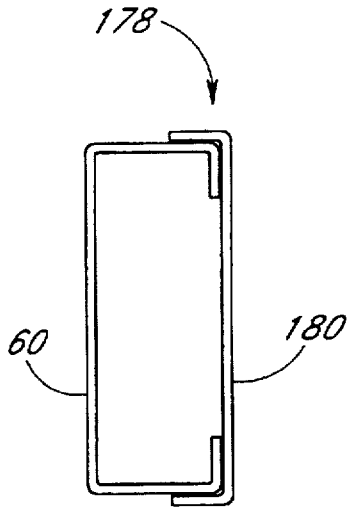

As will be appreciated by one of skill in the art, various other structural members may be formed by a combination of the structural beams 60 and the track elements. In FIG. 10*a*, an end view of one of the C-shaped structural beams 60 is shown. FIG. 10*b* illustrates a box structure 178 wherein a structural beam 60 is received within a portion of track 180. The track 180 is that which is used for the base track 108, the lower header track 148, and the upper header track 164. The box configuration 178 is stronger than the C-shaped channel of the structural beam 60 and may be formed by utilizing the pieces of steel thus far described. That is, to form a stronger beam, one need only join a C-shaped beam 60 with one of the track elements 180. There is no need to identify various gauges of steel in the framing system. The beams may be formed off site or customized on site when needed. The elimination of decisions with regard to the particular gauge of steel used in a specific area of the framing system greatly facilitates construction and reduces labor costs.

Figure 10C:
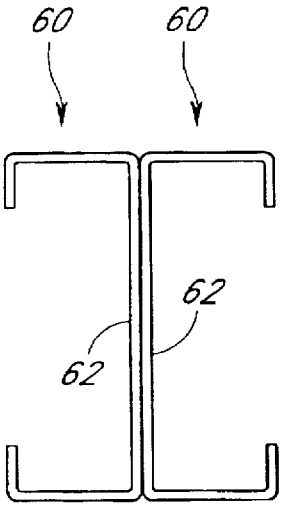

FIG. 10*c* illustrates two of the structural beams 60 attached back to back or along their webs 62. The back-to-back back arrangement of FIG. 10*c* is primarily used with purlin roof systems.

Figure 10D:
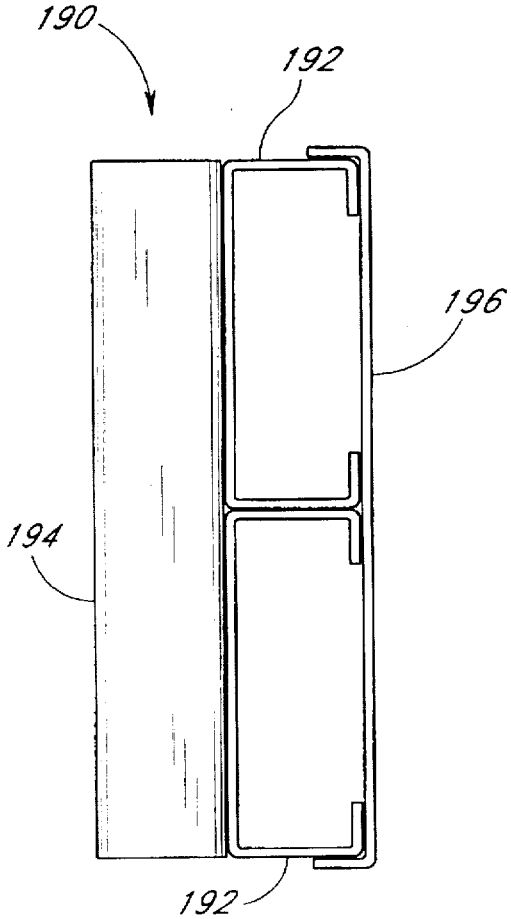

FIG. 10*d* illustrates a beam 190 having a stacked C-arrangement in which a pair of structural beams 192 attach to one or more short C-shaped structural beams or stiffeners 194. The stiffener 194 preferably comprises a short portion of the afore-described structural beam 60. The structural beams 190 preferably have a width of approximately 6 inches, and thus the short stiffener 194 is approximately 12 inches long. Optionally, a 12-inch wide section of track member 196 may be coupled over the open channels of the structural beams 192 for added strength. The stacked C-structure 190 is primarily used with floor joist applications.

Methods of Construction of Steel-Framing System

The framing system constructed using the structural members described herein may be formed using various steel-framing methods. Primarily, however, there are two construction methods which reduce labor. A first method is to construct the exterior walls first, the walls being raised and then connected by the ceiling and floor joists. A second method, which works best with light commercial, out buildings, or other such structures, involves constructing vertical slices of the framing system having wall studs, floor joists, and ceiling joists connected together, the vertical slices then being propped up and joined together with an upper L-bracket.

With reference to FIGS. 6 and 9, the first method wherein the exterior wall is first constructed comprises first placing the base track 108 on one of its flanges 116 on a flat surface. Precut vertical wall studs 104 are then inserted into the base track 108 between the flanges 116 and fastened thereto using the aligned hole patterns.

As mentioned above, the present distribution of circular hole patterns 72 along each beam allows the wall studs 104 to be located at a specified on-center distance which are multiples of 8 inches, and are usually 16 or 24 inches. This flexibility in construction and ease of assembly in light-gauge steel framing has not previously been available. Furthermore, as seen in FIG. 5, the beams are normally cut along lines through the centers of the conduit apertures 78. The two holes laterally disposed from each conduit aperture 78 assist in locating the precise line to cut the beam 60. Thus, the centers of the circular hole patterns 72 begin at distances of 3 inches or 5 inches from the terminal end of each beam.

In one especially advantageous application of this feature, the provision of two pairs of hole patterns every 8" allows for connection of the beams 60 at intervals spaced apart by distances which are multiples of 8", while the center of each hole pattern connection can be offset by 2". In one configuration, for example, the lower end of the wall studs 104, as in FIG. 6, are fastened into the base track 108. The flanges 116 of the track 108 attach to the holes 80 provided in the flanges 64 of the upstanding wall studs 104. As the track flanges 116 extend upward approximately 1 inch, horizontal floor joists 106 attach to the lower end of the wall studs 104 just above the track 108 and, specifically, to the circular hole pattern 72 centered 5 inches above the track. Alternatively, as seen in FIG. 7, the upper ends of the wall studs 104 attach to the circular pattern 72 in each ceiling joist 100 which is centered 3 inches from the end of the ceiling joist. The option of using either of the hole patterns provides great flexibility in constructing steel framing systems. In general, any terminal end of a structural beam 60, whether cut through the conduit aperture 78 or not, provides a datum line from which two sets of circular hole patterns 72 set 2 inches apart can be measured.

Window and door headers, such as 150 or 162, are located and installed between the wall studs 104. The king studs 132, sills 134, and cripples 136 are also installed at this time. The upper L-angle bracket 112 attaches to a specified location on each of the vertical wall studs 104. The L-angle bracket 112 is installed at the height of the roof or, in the case of a multi-story building, at the next floor height. The entire wall assembly is then turned on its opposite face and all of the diagonal cross braces 110 attached. The assembled wall structure 92 is then raised and placed on the slab or foundation 94 and temporarily braced in a vertical position. After the opposing wall has been assembled and raised in a like manner, the roof joists 104 and floor joists 106 are attached between the opposed walls. At this time, any interior load-bearing walls are then erected and coupled to the exterior walls. Gable end walls are assembled and located in a similar fashion. Finally, the roof system comprising the trusses or rafters 102 is installed at the specified angle to the vertical wall studs 104.

In a second method of construction, the base tracks 108 are positioned and attached to the slab or foundation 94. Opposed wall studs 104 are laid flat, and roof and floor joists 100, 106 are attached thereto. The roof system comprising trusses or roof rafters 102 is then assembled and attached to the wall studs 104 lying on the ground. Any interior load-bearing stud is positioned and attached to the roof joists 100 using the specified hole patterns 72. The entire assembly comprises a vertical slice of the framing system and is then raised and temporarily braced in place on the appropriate locations over the base track 108. When the entire building or a maximum of 20 feet in length has been raised, the L-angle bracket 112 is installed below the roof joists 100. Following the specified hole patterns, the wall studs 104 will be in parallel. Next, the cross bracing 110 is attached to the exterior of the walls 92. Finally, the gable end walls are assembled and located.

Although this invention has been described in terms of certain preferred embodiments, other embodiments that are apparent to those of ordinary skill in the art are also within the scope of this invention. Accordingly, the scope of the invention is intended to be defined by the claims that follow.

I claim:

1. A structural beam for framing, comprising:

a rectangular web comprising an inner planar surface, an outer planar surface, a first end, a second end, a first side and a second side, said web defining a longitudinal axis extending between its ends, said web further defining a plurality of identical hole patterns, each of said plurality of hole patterns comprising:

a conduit aperture intersecting said longitudinal axis of said web;

a first center hole sized and shaped to receive a screw, said first center hole intersecting said longitudinal axis of said web;

a first plurality of outer holes positioned in a first circular arrangement around said first center hole, each of said first plurality of outer holes sized and shaped to receive a screw;

a second center hole sized and shaped to receive a screw, said second center hole intersecting said longitudinal axis of said web, wherein said first center hole and said second center hole are located closer to a center position between a first conduit aperture and a second conduit aperture along said longitudinal axis of said web than any other hole; and a second plurality of outer holes positioned in a second circular arrangement around said second center hole, each of said second plurality of outer holes sized and shaped to receive a screw, wherein at least some of outer holes of said first circular arrangement and said second circular arrangement overlap;

said beam further comprising:

a first flange having an inner side and an outer side, said first flange integrally formed with said first side of said web and extending substantially perpendicular to said web, said first flange extending substantially between said first end and said second end of said web;

a second flange having an inner side and an outer side, said second flange integrally formed with said second side of said web and extending substantially perpendicular to said web, said second flange extending substantially between said first end and said second end of said web;

a first lip integrally formed with said outer side of said first flange, said first lip extending substantially perpendicular to said first flange and substantially parallel to said web, said first lip extending substantially between said first end and said second end of said web;

a second lip integrally formed with said outer side of said second flange, said second lip extending substantially perpendicular to said second flange and substantially parallel to said web, said second lip extending substantially between said first end and said second end of said web.

2. The structural beam of claim 1, wherein only five holes in said pattern, including said conduit aperture, are aligned with said longitudinal axis.

3. The structural beam of claim 2, wherein said first and said second plurality of outer holes each include a first grouping of holes, a second grouping of holes, a third grouping of holes and a fourth grouping of holes, said first grouping of holes axisymmetrically opposed to said third grouping of holes about said center hole and said second grouping of holes axisymmetrically opposed to said fourth grouping of holes.

4. The structural beam of claim 3, wherein each said grouping has at least three holes.

5. The structural beam of claim 4, wherein said first circular arrangement further comprises a first pair of holes perpendicular to said longitudinal axis such that a line connecting said first pair of holes intersects said first center hole and said second circular arrangement further comprises a second pair of holes perpendicular to said longitudinal axis such that a line connecting said second pair of holes intersects said second center hole.

6. The structural beam of claim 5, further comprising a third pair of holes perpendicular to said longitudinal axis such that a line connecting said third pair of holes intersects the axis of said conduit aperture.

7. The structural beam of claim 1, wherein only five holes in said plurality of patterns, including said conduit aperture, are aligned with said longitudinal axis.

8. A structural beam for framing, comprising:

a rectangular web comprising an inner planar surface, an outer planar surface, a first end, a second end, a first side and a second side, said web defining a longitudinal axis extending between its ends, said web further defining a plurality of identical hole patterns, each of said plurality of hole patterns comprising:

a conduit aperture intersecting said longitudinal axis of said web;

a first center hole sized and shaped to receive a screw, said first center hole intersecting said longitudinal axis of said web;

a first plurality of outer holes positioned in a first circular arrangement around said first center hole, each of said first plurality of outer holes sized and shaped to receive a screw said first plurality of outer holes including a first grouping of holes, a second grouping of holes, a third grouping of holes and a fourth grouping of holes, said first grouping of holes axisymmetrically opposed to said third grouping of holes about said center hole and said second grouping of holes axisymmetrically opposed to said fourth grouping of holes, wherein each said grouping has at least three holes;

a first flange having an inner side and an outer side, said first flange integrally formed with said first side of said web and extending substantially perpendicular to said web, said first flange extending substantially between said first end and said second end of said web;

a second flange having an inner side and an outer side, said second flange integrally formed with said second side of said web and extending substantially perpendicular to said web, said second flange extending substantially between said first end and said second end of said web;

a first lip integrally formed with said outer side of said first flange, said first lip extending substantially perpendicular to said first flange and substantially parallel to said web, said first lip extending substantially between said first end and said second end of said web; and a second lip integrally formed with said outer side of said second flange, said second lip extending substantially perpendicular to said second flange and substantially parallel to said web, said second lip extending substantially between said first end and said second end of said web.

9. The structural beam of claim 8, wherein said first circular arrangement further comprises a first pair of holes perpendicular to said longitudinal axis such that a line connecting said first pair of holes intersects said first center hole.

10. The structural beam of claim 9, further comprising a third pair of holes perpendicular to said longitudinal axis such that a line connecting said third pair of holes intersects the axis of said conduit aperture.

11. A structural framing unit, comprising:

a first structural beam, comprising:

a rectangular web comprising an inner planar surface, an outer planar surface, a first end, a second end, a first side and a second side, said web defining a longitudinal axis extending between its ends, said web further defining a plurality of identical hole patterns, each of said plurality of hole patterns comprising:

a conduit aperture intersecting said longitudinal axis of said web;

a first center hole sized and shaped to receive a screw, said first center hole intersecting said longitudinal axis of said web;

a first plurality of outer holes positioned in a first arrangement around said first center hole, each of said first plurality of outer holes sized and shaped to receive a screw, said first plurality of outer holes including a first grouping of holes, a second grouping of holes, a third grouping of holes and a fourth grouping of holes, said first grouping of holes axisymmetrically opposed to said third grouping of holes about said center hole and said second grouping of holes axisymmetrically opposed to said fourth grouping of holes;

a first flange having an inner side and an outer side, said first flange integrally formed with said first side of said web and extending substantially perpendicular to said web, said first flange extending substantially between said first end and said second end of said web;

a second flange having an inner side and an outer side, said second flange integrally formed with said second side of said web and extending substantially perpendicular to said web, said second flange extending substantially between said first end and said second end of said web;

a second structural beam, comprising:

a rectangular web comprising an inner planar surface, an outer planar surface, a first end, a second end, a first side and a second side, said web defining a longitudinal axis extending between its ends, said web further defining a plurality of identical hole patterns, each of said plurality of hole patterns comprising:

a conduit aperture intersecting said longitudinal axis of said web;

a first center hole sized and shaped to receive a screw, said first center hole intersecting said longitudinal axis of said web;

a first plurality of outer holes positioned in a first arrangement around said first center hole, each of said first plurality of outer holes sized and shaped to receive a screw, said first plurality of outer holes including a first grouping of holes, a second grouping of holes, a third grouping of holes and a fourth grouping of holes, said first grouping of holes axisymmetrically opposed to said third grouping of holes about said center hole and said second grouping of holes axisymmetrically opposed to said fourth grouping of holes;

a first flange having an inner side and an outer side, said first flange integrally formed with said first side of said web and extending substantially perpendicular to said web, said first flange extending substantially between said first end and said second end of said web;

a second flange having an inner side and an outer side, said second flange integrally formed with said second side of said web and extending substantially perpendicular to said web, said second flange extending substantially between said first end and said second end of said web;

a first screw extending through one of said center holes of said first beam and one of said center holes of said second beam so as to secure said outer planar surface of said first beam against said outer planar surface of said second beam, whereby said beams are rotatable about said screw to at least four discrete angles, wherein at least three spaced holes of said first plurality of holes of said first beam are aligned at each of said discrete angles with said first plurality of holes of said second beam.

12. The structural unit of claim 11, wherein at least four generally equally spaced holes of said first plurality of holes of said first beam are aligned at each of said discrete angles with said first plurality of holes of said second beam.

13. The structural unit of claim 12, wherein less than twenty-five holes of said first plurality of holes of said first beam are aligned at each of said discrete angles with said first plurality of holes of said second beam.

14. The structural unit of claim 12, wherein less than twenty holes of said first plurality of holes of said first beam are aligned at each of said discrete angles with said first plurality of holes of said second beam.

15. The structural unit of claim 12, wherein less than fifteen holes of said first plurality of holes of said first beam are aligned at each of said discrete angles with said first plurality of holes of said second beam.

16. The structural unit of claim 11, wherein less than twenty-five holes of said first plurality of holes of said first beam are aligned at each of said discrete angles with said first plurality of holes of said second beam.

17. The structural unit of claim 16, wherein less than twenty holes of said first plurality of holes of said first beam are aligned at each of said discrete angles with said first plurality of holes of said second beam.

18. The structural unit of claim 17, wherein less than fifteen holes of said first plurality of holes of said first beam are aligned at each of said discrete angles with said first plurality of holes of said second beam.

19. The structural unit of claim 12, wherein each of said first beam and said second beam further comprise a second center hole along its longitudinal axis, and a second plurality of outer holes positioned in a second arrangement around said second center hole, each of said second plurality of outer holes sized and shaped to receive a screw.

20. The structural unit of claim 19, wherein less than twenty-five holes of said first plurality of holes of said first beam are aligned at each of said discrete angles with one of said first and said second plurality of holes of said second beam.

* * * * *